US010121574B2

(12) United States Patent
Nagase et al.

(10) Patent No.: US 10,121,574 B2
(45) Date of Patent: Nov. 6, 2018

(54) RESISTOR AND METHOD FOR MANUFACTURING RESISTOR

(71) Applicant: MITSUBISHI MATERIALS CORPORATION, Tokyo (JP)

(72) Inventors: Toshiyuki Nagase, Gotenba (JP); Masahito Komasaki, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 15/544,126

(22) PCT Filed: Jan. 27, 2016

(86) PCT No.: PCT/JP2016/052393
§ 371 (c)(1),
(2) Date: Jul. 17, 2017

(87) PCT Pub. No.: WO2016/121838
PCT Pub. Date: Aug. 4, 2016

(65) Prior Publication Data

US 2018/0012685 A1 Jan. 11, 2018

(30) Foreign Application Priority Data

Jan. 28, 2015 (JP) ..... 2015-014405

(51) Int. Cl.
*H01C 1/012* (2006.01)
*H01C 1/144* (2006.01)
(Continued)

(52) U.S. Cl.
CPC ..... *H01C 1/144* (2013.01); *H01C 1/012* (2013.01); *H01C 1/084* (2013.01); *H01C 7/003* (2013.01); *H01C 17/006* (2013.01)

(58) Field of Classification Search
CPC ..... H01C 1/144; H01C 1/012; H01C 1/084; H01C 7/003; H01C 17/006
(Continued)

(56) References Cited

U.S. PATENT DOCUMENTS 5,563,572 A * 10/1996 Hetzler ..... H01C 1/084 338/203
5,990,780 A * 11/1999 Caddock, Jr. ..... H01C 1/08 338/309
(Continued)

FOREIGN PATENT DOCUMENTS

CN 101243524 A 8/2008
EP 1345480 A2 9/2003
(Continued)

OTHER PUBLICATIONS

JP 2009-200258, Igarashi, dated Sep. 2009. Machine translation.*
(Continued)

*Primary Examiner* — Kyung Lee
(74) *Attorney, Agent, or Firm* — Locke Lord LLP

(57) ABSTRACT

The resistor includes a chip resistive element which includes a resistive element and metal electrodes and which is formed on first surface of a ceramic substrate, metal terminals electrically joined to the metal electrodes, and an Al member formed on the second surface side of the ceramic substrate, wherein the ceramic substrate and the Al member are joined using an Al—Si-based brazing filler metal, the metal electrodes and the metal terminals are joined to each other using a solder, and a degree of bending of an opposite surface of the Al member opposite to a surface on the ceramic substrate side is in a range of −30 μm/50 mm to 700 μm/50 mm.

11 Claims, 9 Drawing Sheets

(51) Int. Cl.
*H01C 7/00* (2006.01)
*H01C 1/084* (2006.01)
*H01C 17/00* (2006.01)

(58) Field of Classification Search
USPC ..... 338/306
See application file for complete search history.

(56) References Cited

U.S. PATENT DOCUMENTS

| | | | | |
|---|---|---|---|---|
| 7,053,749 | B2 * | 5/2006 | Ishida | H01C 1/144 338/323 |
| 7,190,252 | B2 * | 3/2007 | Smith | H01C 1/084 338/22 R |
| 7,994,895 | B2 * | 8/2011 | Coolbaugh | H01C 1/084 257/701 |
| 9,502,161 | B2 * | 11/2016 | Smith | H01C 1/148 |
| 2011/0156860 | A1 * | 6/2011 | Smith | H01C 1/084 338/328 |
| 2013/0328184 | A1 | 12/2013 | Iwayama et al. | |

FOREIGN PATENT DOCUMENTS

| | | | |
|---|---|---|---|
| JP | 08-306861 | A | 11/1996 |
| JP | 10-247763 | A | 9/1998 |
| JP | 3180677 | B2 | 6/2001 |
| JP | 2002-503026 | A | 1/2002 |
| JP | 2007-273661 | A | 10/2007 |
| JP | 2009-105166 | A | 5/2009 |
| JP | 2009-200258 | A | 9/2009 |
| JP | 2010-287842 | A | 12/2010 |
| JP | 2015-095625 | A | 5/2015 |
| JP | 2015-095626 | A | 5/2015 |
| WO | 99/40590 | A1 | 8/1999 |

OTHER PUBLICATIONS

JP 2010-287842, Mizoguchi, dated Dec. 2010, Machine translation.*
JP 2007-273661, Shiomo et al., dated Oct. 2007, Machine translation.*
JP 10-247763, Kadota et al., dated Sep. 1998, Machine translation.*
International Search Report dated Apr. 12, 2016, issued for PCT/JP2016/052393 and English translation thereof.
Office Action dated May 15, 2018, issued for corresponding Japanese Patent Application No. 2015-014405.
Office Action dated May 23, 2018, issued for corresponding Chinese Patent Application No. 2016800054668. English translation of search report.
The extended European search report dated Sep. 20, 2018 issued for corresponding European Patent Application No. 16743441.4.

* cited by examiner

RESISTOR AND METHOD FOR MANUFACTURING RESISTOR

TECHNICAL FIELD

The present invention relates to a resistor including a chip resistive element which has a resistive element and metal electrodes and which is formed on first surface of a ceramic substrate, metal terminals joined to the metal electrodes, and an Al member made of Al or an Al alloy, and a method for manufacturing this resistor.

Priority is claimed on Japanese Patent Application No. 2015-014405, filed on Jan. 28, 2015, the content of which is incorporated herein by reference.

BACKGROUND ART

As an example of electronic circuit components, resistors including a resistive element formed on one surface of a ceramic substrate and a metal terminal joined to this resistive element are widely used. In the resistors, joule heat is generated proportionately to the value of applied currents, and resistors generate heat. In order to efficiently diffuse the heat generated in resistors, for example, devices including a heat-diffusing plate (heat sink) are proposed.

For example, Patent Document 1 proposes a resistor in which a silicon substrate including an insulating layer and a heat-diffusing plate (heat sink) made of Al are soldered to each other.

CITATION LIST

Patent Document

[Patent Document 1] Japanese Unexamined Patent Application, First Publication No. H8-306861

DISCLOSURE OF INVENTION

Technical Problem

In a case in which a substrate made of ceramic and a heat-diffusing plate made of Al are joined to each other, the substrate and the heat-diffusing plate are likely to bend due to a difference in the coefficient of thermal expansion or thermal conductivity between the materials. Particularly, heat-diffusing plates made of Al having lower stiffness than ceramics may significantly bend in some cases. This bending can be alleviated by pressing a joined body of the substrate and the heat-diffusing plate after the substrate and the heat-diffusing plate have joined to each other.

However, in the case of joining methods of the related art, for example, a case in which a substrate and a heat-diffusing plate are soldered to each other as described in Patent Document 1, when bending is corrected by pressing in the post steps, cracks are likely to be generated from the solder and there is a concern that the substrate and the heat-diffusing plate may peel off from each other.

This invention has been made in consideration of the above-described circumstances, and an object of the present invention is to provide a resistor in which a ceramic substrate and an Al member are joined to each other without being bent and a joint portion is not damaged, and a method for manufacturing the resistor.

Solution to Problem

In order to achieve the above-described object, a resistor of the present invention includes a chip resistive element which includes a resistive element and metal electrodes and which is formed on first surface of a ceramic substrate, metal terminals electrically joined to the metal electrodes, and an Al member formed on the second surface side of the ceramic substrate, wherein the ceramic substrate and the Al member are joined to each other using an Al—Si-based brazing filler metal, the metal electrodes and the metal terminals are joined to each other using a solder, and a degree of bending of an opposite surface of the Al member opposite to a surface on the ceramic substrate side is in a range of −30 μm/50 mm to 700 μm/50 mm.

In the resistor of the present invention, the degree of bending is an index indicating the flatness of the opposite surface and is represented by a difference between the highest point and the lowest point on a least square surface. In addition, the degree of bending has a positive numerical value in a state in which the central region of the opposite surface protrudes to the exterior more than the circumferential region and the degree of bending has a negative numerical value in a state in which the circumferential region of the opposite surface protrudes to the exterior more than the central region. The above-described warpage of the opposite surface does not necessarily have a warpage shape in which an arbitrary cross-section of the opposite surface in a surface-expanding direction becomes symmetric and may have a warpage shape in which the cross-section of the opposite surface becomes asymmetric as long as the amount of warpage is in a range of −30 μm/50 mm to 700 μm/50 mm with respect to a flat surface.

According to the resistor of the present invention, the resistor is formed so that the amount of warpage of the opposite surface of the Al member is in a range of −30 μm/50 mm to 700 μm/50 mm with respect to a flat surface, and thus the generation of an excessive bending stress on a joint surface between the ceramic substrate and the Al member caused by the bending of the Al member is suppressed, and it is possible to prevent peeling of the ceramic substrate or deformation of the ceramic substrate.

In addition, even when a new member is further joined to the opposite surface of the Al member, it is possible to ensure adhesiveness between the Al member and the new member.

It is preferable that the Al member be a laminate of a buffer layer made of Al having a purity of 99.98% by mass or more and a heat sink, and the buffer layer and the second surface of the ceramic substrate be joined to each other using an Al—Si-based brazing filler metal.

When the Al member is constituted of a laminate of a buffer layer made of Al having a purity of 99.98% by mass or more and a heat sink, it is possible to effectively transfer the heat generated in the chip resistive element to the heat sink and rapidly diffuse the heat. In addition, when the buffer layer is formed of highly pure Al having a purity of 99.98% by mass or more, deformation resistance decreases, a thermal stress being generated in the ceramic substrate when a thermal cycle is applied can be absorbed by the buffer layer, and it becomes possible to suppress the occurrence of breakage caused by the application of a thermal stress to the ceramic substrate.

In the present invention, it is preferable that a thickness of the buffer layer be in a range of 0.4 mm to 2.5 mm.

When the thickness of the buffer layer is less than 0.4 mm, there is a concern that it may not be possible to sufficiently buffer the deformation caused by a thermal stress. In addition, when the thickness of the buffer layer exceeds 2.5 mm, there is a concern that it may become difficult to efficiently transfer the heat to the Al member.

In the present invention, it is preferable that the chip resistive element, the metal electrodes, and the metal terminals be at least partially covered with an insulating sealing resin and the sealing resin be a resin having a coefficient of thermal expansion in a range of 8 ppm/° C. to 20 ppm/° C.

In this case, since the chip resistive element and the metal terminal are molded with the insulating sealing resin, it is possible to prevent current leakage and realize high pressure resistance of the resistor. In addition, since a resin having a coefficient of thermal expansion (linear expansion rate) in a range of 8 ppm/° C. to 20 ppm/° C. is used as the sealing resin, it is possible to minimize the volume changes caused by the thermal expansion of the sealing resin caused by the generation of heat from the resistive element. Therefore, it is possible to prevent the joint portion from being damaged by the application of an excessive stress to the chip resistive element or the metal terminal covered with the sealing resin and from occurring problems such as poor electrical conduction.

In the present invention, it is preferable that a thickness of the ceramic substrate be in a range of 0.3 mm to 1.0 mm and a thickness of the Al member be in a range of 2.0 mm to 10.0 mm.

When the thickness of the ceramic substrate is set within a range of 0.3 mm to 1.0 mm, it is possible to satisfy both the strength of the ceramic substrate and the thickness reduction of the entire resistor. In addition, when the thickness of the Al member is set within a range of 2.0 mm to 10.0 mm, it is possible to ensure sufficient thermal capacity and reduce the thickness of the entire resistor.

A method for manufacturing a resistor of the present invention is a method for manufacturing a resistor with which the respective resistors described above are manufactured, including: a joining step of disposing an Al—Si-based brazing filler metal between the ceramic substrate and the Al member, heating the ceramic substrate and the Al member under pressure in a lamination direction, and joining the ceramic substrate and the Al member to each other using the brazing filler metal, thereby forming a joined body; and a bending correction step of correcting the bending of the Al member.

According to the method for manufacturing a resistor of the present invention, it is possible to form a resistor so that the degree of bending of the opposite surface of the Al member falls into a range of −30 μm/50 mm to 700 μm/50 mm with respect to a flat surface using the bending correction step. Therefore, it is possible to suppress the generation of an excessive bending stress on the joint surface between the ceramic substrate and the Al member caused by bending of the Al member and to prevent peeling of the ceramic substrate or deformation of the ceramic substrate.

In addition, even when a new member is further joined to the opposite surface of the Al member, it becomes possible to ensure adhesiveness between the Al member and the new member.

It is preferable that the bending correction step be a step of carrying out cold correction in which a correction jig having a predetermined curvature is brought into contact with the Al member side of the joined body and the joined body is pressed from the ceramic substrate side.

In this case, it becomes possible to cause the degree of bending of the opposite surface of the Al member to fall into a range of −30 μm/50 mm to 700 μm/50 mm with respect to a flat surface.

It is preferable that the bending correction step be a step of carrying out pressure cooling correction in which the joined body is sandwiched by flat correction jigs respectively disposed on the Al member side and the ceramic substrate side and is cooled to at least 0° or lower and is then returned to room temperature.

In this case, it becomes possible to cause the degree of bending of the opposite surface of the Al member to fall into a range of −30 μm/50 mm to 700 μm/50 mm with respect to a flat surface.

It is preferable that the bending correction step be a step of disposing a correction jig having a predetermined curvature on the Al member side prior to the joining step.

In this case, it becomes possible to cause the degree of bending of the opposite surface of the Al member to fall into a range of −30 μm/50 mm to 700 μm/50 mm with respect to a flat surface.

The method for manufacturing a resistor of the present invention preferably further includes a sealing resin-forming step of disposing a mold so as to surround a circumference of the chip resistive element and loading a softened sealing resin to an inside of the mold.

In this case, since the chip resistive element and the metal terminal are molded with the insulating sealing resin, it is possible to prevent current leakage and manufacture resistors having a high pressure resistance. In addition, when the chip resistive element and the metal terminal are covered with the sealing resin, it is possible to manufacture resistors in which damaging of the joint portion due to the application of an excessive stress to the chip resistive element or the metal terminal and the occurrence of problems such as poor electrical conduction may be prevented.

Advantageous Effects of Invention

According to the present invention, it is possible to provide a resistor which has excellent heat resistance and is capable of suppressing the deterioration of resistive elements or joined portions during manufacturing, and a method for manufacturing a resistor.

BEST MODE FOR CARRYING OUT THE INVENTION

Hereinafter, a resistor of the present invention and a method for manufacturing this resistor will be described with reference to the accompanying drawings.

However, individual embodiments described below are specific descriptions for an easier understanding of the gist of the present invention and do not limit the present invention unless particularly otherwise described. In addition, in drawings to be used in the following descriptions, there are cases in which main portions are illustrated in an enlarged manner for convenience in order to facilitate the understanding of the characteristics of the present invention, and the dimensional ratios and the like of individual constituent elements are not always the same as those in the actual cases.

Resistor: First Embodiment

A first embodiment of the resistor of the present invention will be described with reference to FIG. 1.

Figure 1:
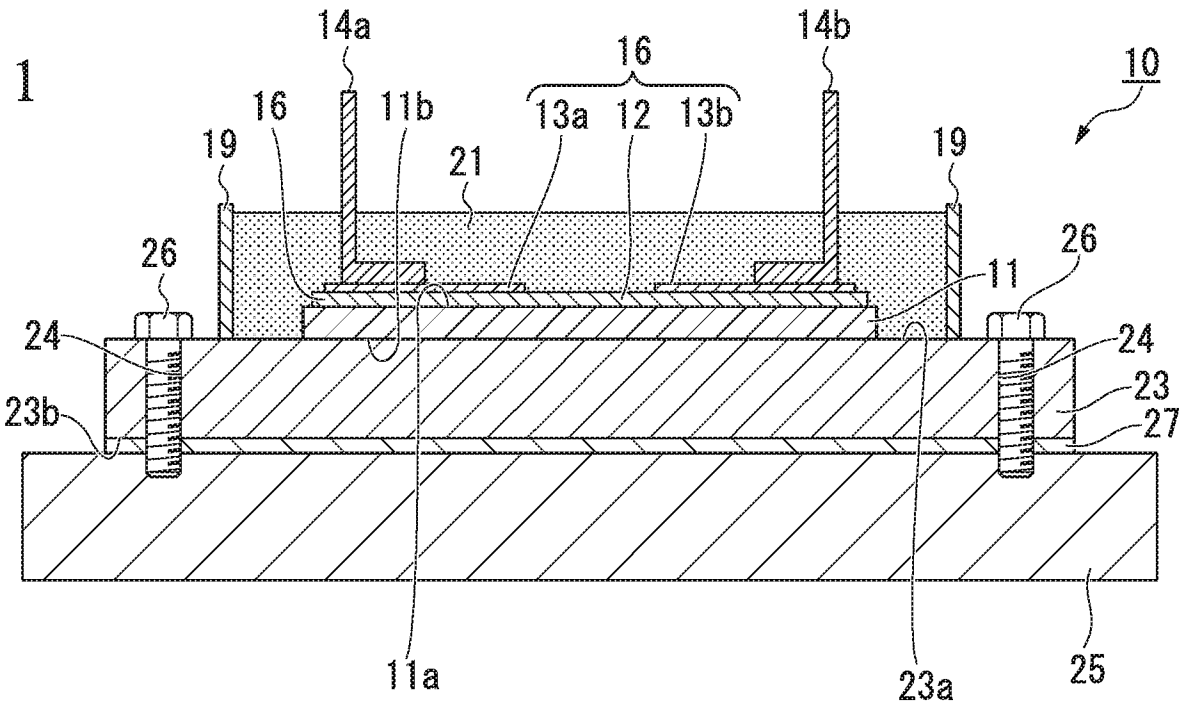
FIG. 1 is a cross-sectional view of a resistor according to a first embodiment of the present invention.

FIG. 1 is a cross-sectional view illustrating a cross-section of the resistor of the first embodiment in a lamination direction. A resistor 10 according to the first embodiment includes a ceramic substrate 11 and a chip resistive element 16 formed so as to overlay first surface 11*a* of the ceramic substrate 11. The chip resistive element 16 has a resistive element 12 and metal electrodes 13*a* and 13*b* for applying voltage to the resistive element 12. In addition, metal terminals 14*a* and 14*b* are disposed so as to overlay the metal electrodes 13*a* and 13*b* respectively. The metal electrode 13*a* and the metal terminal 14*a*, and the metal electrode 13*b* and the metal terminal 14*b* are respectively joined to each other using a solder.

Furthermore, a mold 19 which is not in contact with the chip resistive element 16 and surrounds the chip resistive element is disposed around the chip resistive element 16. In addition, a sealing resin 21 is loaded to the inside of the mold 19. The loaded sealing resin 21 is formed so as to cover a part of the chip resistive element 16 and the metal terminals 14*a* and 14*b*.

A heat sink (Al member) 23 which is an Al member is disposed so as to overlay second surface 11*b* of the ceramic substrate 11.

A joint structure of the ceramic substrate 11 and the heat sink 23 will be described below in detail.

A plurality of screw holes 24 are formed near the circumferential edge of the heat sink 23.

It is preferable that a cooler 25 be further attached to a surface opposite to a joint surface on which the heat sink 23 is joined to the ceramic substrate 11. The cooler 25 is fastened to the heat sink 23 using screws 26 penetrating the screw holes 24 in the heat sink 23. It is preferable that a highly heat-conductive grease layer 27 be further formed between the cooler 25 and the heat sink 23.

The ceramic substrate 11 is intended to prevent electrical connection between the resistive element 12 or the metal electrode 13 and the conductive heat sink 23. The ceramic substrate 11 is constituted of an insulating and highly heat-resistant ceramic such as silicon nitride ($Si_3N_4$), aluminum nitride (AlN), or alumina ($Al_2O_3$). In the present embodiment, the ceramic substrate is constituted of highly insulating AlN. In addition, the thickness of the ceramic substrate 11 made of AlN is, for example, preferably in a range of 0.3 mm to 1.0 mm and more preferably in a range of 0.5 mm to 0.83 mm. In the present embodiment, the thickness of the ceramic substrate 11 is set to 0.635 mm.

When the thickness of the ceramic substrate 11 is less than 0.3 mm, there is a concern that it may not be possible to ensure a sufficient strength to the stress being applied to the ceramic substrate 11. In addition, when the thickness of the ceramic substrate 11 exceeds 1.0 mm, the thickness of the entire resistor 10 increases, and there is a concern that thickness reduction may become difficult. Therefore, when the thickness of the ceramic substrate 11 is set within a range of, for example, 0.3 mm to 1.0 mm, it is possible to satisfy both the strength of the ceramic substrate 11 and the thickness reduction of the entire resistor 10.

The resistive element 12 is intended to function as an electric resistance when currents are caused to flow in the resistor 10, and examples of the constituent materials include Ta—Si-based thin film resistive elements, $RuO_2$ thick film resistive elements, and the like. In the present embodiment, the resistive element 12 is constituted of a Ta—Si-based thin film resistive element and has a thickness set to, for example, 0.5 μm.

The metal electrodes 13*a* and 13*b* are electrodes provided in the resistive element 12 and, in the present embodiment, are constituted of Cu. In addition, the thickness of the metal electrodes 13*a* and 13*b* is set to, for example, 2 μm or more and 3 μm or less and, in the present embodiment, is set to 1.6 μm. In the present embodiment, Cu constituting the metal electrodes 13*a* and 13*b* contains pure Cu or a Cu alloy. In addition, the constituent material of the metal electrodes 13*a* and 13*b* is not limited to Cu, and it is possible to employ, for example, a variety of metals having a high electric conductivity such as Al and Ag.

The metal terminals 14*a* and 14*b* are electric terminals having an outer shape bent in a substantial L shape and are joined to the surfaces of the metal electrodes 13*a* and 13*b* using a solder on one end side. Therefore, the metal terminals 14*a* and 14*b* are electrically connected to the metal electrodes 13*a* and 13*b*. In addition, the other end side of each of the metal electrodes 13*a* and 13*b* protrudes from the sealing resin 21 and is exposed to the outside. In the present embodiment, the metal terminals 14*a* and 14*b* are constituted of, for example, similar to the metal electrode 13, Cu. In addition, the thickness of the metal terminal 14 is set to 0.1 mm or more and 0.5 mm or less and, in the present embodiment, is set to 0.3 mm.

Examples of the solder used to join the metal terminals 14*a* and 14*b* and the metal electrodes 13*a* and 13*b* include Sn—Ag-based solders, Sn—In-based solders, and Sn—Ag—Cu-based solders.

The resistor 10 is connected to the external electronic circuits and the like through the metal terminals 14*a* and 14*b*.

The metal terminal 14*a* is used as a (positive or negative) terminal of the resistor 10, and the metal terminal 14*b* is used as a (negative or positive) terminal of the resistor 10.

The mold 19 is constituted of, for example, a heat-resistant resin plate. In addition, as the sealing resin 21 filling the inside of the mold 19, for example, an insulating resin having a coefficient of thermal expansion (linear expansion rate) in a range of 8 ppm/° C. to 20 ppm/° C. in a temperature range of 30° C. to 120° C. is used. The coefficient of thermal expansion in a temperature range of 30° C. to 120° C. is more preferably 12 ppm/° C. to 18 ppm/° C. Examples of the insulating resin having the above-described coefficient of thermal expansion include resins obtained by doping a $SiO_2$ filler into an epoxy resin. In this case, the sealing resin 21 is desirably provided with a composition including 72% by mass to 84% by mass of a $SiO_2$ filler and 16% by mass to 28% by mass of an epoxy resin and more desirably provided with a composition including 75% by mass to 80% by mass of a $SiO_2$ filler and 20% by mass to 25% by mass of an epoxy resin.

The coefficient of thermal expansion of the sealing resin 21 is measured and computed using DL-7000 manufactured by Advance Riko, Inc.

When an insulating resin having a coefficient of thermal expansion in a range of 8 ppm/° C. to 20 ppm/° C. in a temperature range of 30° C. to 120° C. is used as the sealing resin 21, it is possible to minimize volume changes caused by the thermal expansion of the sealing resin 21 caused by the generation of heat from the resistive element 12. Therefore, it is possible to prevent the joint portion from being damaged by the application of an excessive stress to the chip resistive element 16 or the metal terminals 14*a* and 14*b* covered with the sealing resin 21 and from occurring problems such as poor electrical conduction.

The heat sink (Al member) 23 and the second surface 11*b* of the ceramic substrate 11 are joined to each other using an Al—Si-based brazing filler metal. The boiling point of the Al—Si-based brazing filler metal is approximately 600° C. to 630° C. When the heat sink 23 and the ceramic substrate 11 are joined to each other using the Al—Si-based brazing filler metal, it is possible to add heat resistance and to prevent thermal deterioration during the joining step at the same time.

For example, in a case in which the heat sink and the ceramic substrate are joined to each other using a solder as in the related art, there is a concern that, due to the low boiling point of the solder (approximately 200° C. to 250° C.), the heat sink and the ceramic substrate may peel off from each other in a case in which the resistive element 12 reaches a high temperature. In addition, temperature changes relatively significantly expand and contract the solder, cracks are likely to be generated, and there is a concern that the heat sink and the ceramic substrate may peel off from each other.

Therefore, when the heat sink 23 and the ceramic substrate 11 are joined to each other using an Al—Si-based brazing filler metal as in the present embodiment, heat resistance significantly improves compared with solder joining, and it becomes possible to reliably prevent the generation of cracks in the joint portion between the heat sink and the ceramic substrate due to temperature changes or the peeling between the heat sink and the ceramic substrate.

The heat sink (Al member) 23 is intended to transfer the heat being generated from the resistive element 12 and is formed of Al or an Al alloy having favorable. In the present embodiment, the heat sink 23 is constituted of an A6063 alloy (Al alloy).

The heat sink 23 is formed so that the thickness in the lamination direction preferably falls into a range of 2.0 mm to 10.0 mm and more preferably falls into a range of 2.0 mm to 5.0 mm. When the thickness of the heat sink 23 is less than 2.0 mm, there is a concern that the heat sink 23 may deform when stress is applied to the heat sink 23. In addition, since the thermal capacity is too small, there is a concern that it may not be possible to sufficiently absorb and diffuse the heat being generated from the resistive element 12. On the other hand, when the thickness of the heat sink 23 exceeds 10.0 mm, it also becomes difficult to reduce the thickness of the entire resistor 10 due to the thickness of the heat sink 23, and there is a concern that the weight of the entire resistor 10 may excessively increase.

This heat sink (Al member) 23 is formed so that the degree of bending of an opposite surface 23*b* opposite to a surface 23*a* on the ceramic substrate 11 side falls into a range of −30 μm/50 mm to 700 μm/50 mm.

Here, the degree of bending of the opposite surface 23*b* is an index indicating the flatness of the opposite surface 23*b* of the heat sink 23 and is represented by a difference between the highest point and the lowest point on a least square surface. In addition, the degree of bending has a positive numerical value in a state in which the central region of the opposite surface 23*b* of the heat sink 23 protrudes to the exterior more than the circumferential region and the degree of bending has a negative numerical value in a state in which the circumferential region of the opposite surface 23*b* protrudes to the exterior more than the central region. The warpage of the opposite surface 23*b* of the above-described heat sink 23 does not necessarily have a warpage shape in which an arbitrary cross-section of the opposite surface in a surface-expanding direction becomes symmetric and may have a warpage shape in which the cross-section of the opposite surface becomes asymmetric as long as the amount of warpage is in a range of −30 μm/50 mm to 700 μm/50 mm with respect to a flat surface. The amount of warpage is more preferably in a range of −20 μm/50 mm to 400 μm/50 mm.

The highest point and the lowest point on the least square surface are, in a range of a reference length (50 mm), a point of the location at which the maximum height in the height direction of the least square surface is present (the highest point) and a point at which the location that is the lowest is present (the lowest point) with respect to the location at which the maximum height is present. The amount of warpage is computed by dividing the difference (μm) between the highest point and the lowest point by the reference length (50 mm).

The amount of warpage can be measured by using a laser displacement meter.

When the heat sink is formed so that the amount of warpage of the opposite surface 23*b* of the heat sink 23 falls into a range of −30 μm/50 mm to 700 μm/50 mm with respect to a flat surface, it is possible to prevent peeling of the ceramic substrate 11 due to the bending of the heat sink (Al member) 23 or deformation of the ceramic substrate 11.

In some cases, the opposite surface 23*b* of the heat sink 23, that is, the surface in contact with the cooler 25 may slightly bend due to the joining between the heat sink 23 and the ceramic substrate 11. This is because the coefficient of thermal expansion of Al constituting the heat sink 23 is larger than the coefficient of thermal expansion of the ceramic substrate 11. Therefore, when the heat sink is joined to the ceramic substrate at a high temperature and then cooled to room temperature, the opposite surface 23*b* (the surface in contact with the cooler 25) of the heat sink 23 bends so as to protrude most in the central region in a direction opposite to the ceramic substrate 11.

When the degree of bending of the opposite surface 23*b* of the above-described heat sink 23 is caused to fall into a range of −30 μm/50 mm to 700 μm/50 mm, it is possible to ensure adhesiveness between the heat sink 23 and the cooler 25 even in a case in which the cooler 25 is further provided in the heat sink 23. In addition, it is possible to suppress the generation of an excessive bending stress on the joint surface between the heat sink 23 and the ceramic substrate 11 and prevent peeling between the heat sink 23 and the ceramic substrate 11.

A specific method for controlling the amount of warpage of the opposite surface 23*b* of the heat sink 23 to fall into a range of −30 μm/50 mm to 700 μm/50 mm with respect to a flat surface will be described in detail in a method for manufacturing the resistor.

The cooler 25 is intended to cool the heat sink 23, the cooler 25 diffuses heat from the heat sink 23, and prevents an increase in the temperature of the heat sink 23. The cooler 25 may be, for example, an air cooling-type or water cooling-type cooler. The cooler 25 is fastened to the heat sink 23 using the screws 26 penetrating the screw holes 24 formed in the heat sink 23.

In addition, it is preferable that the highly heat-conductive grease layer 27 be further formed between the cooler 25 and the heat sink 23. The grease layer 27 enhances the adhesiveness between the cooler 25 and the heat sink 23 and smoothly transfers the heat from the heat sink 23 toward the cooler 25. As grease constituting the grease layer 27, a highly heat-resistant grease having excellent thermal conductivity and excellent heat resistance is used.

Resistor: Second Embodiment

Figure 2:
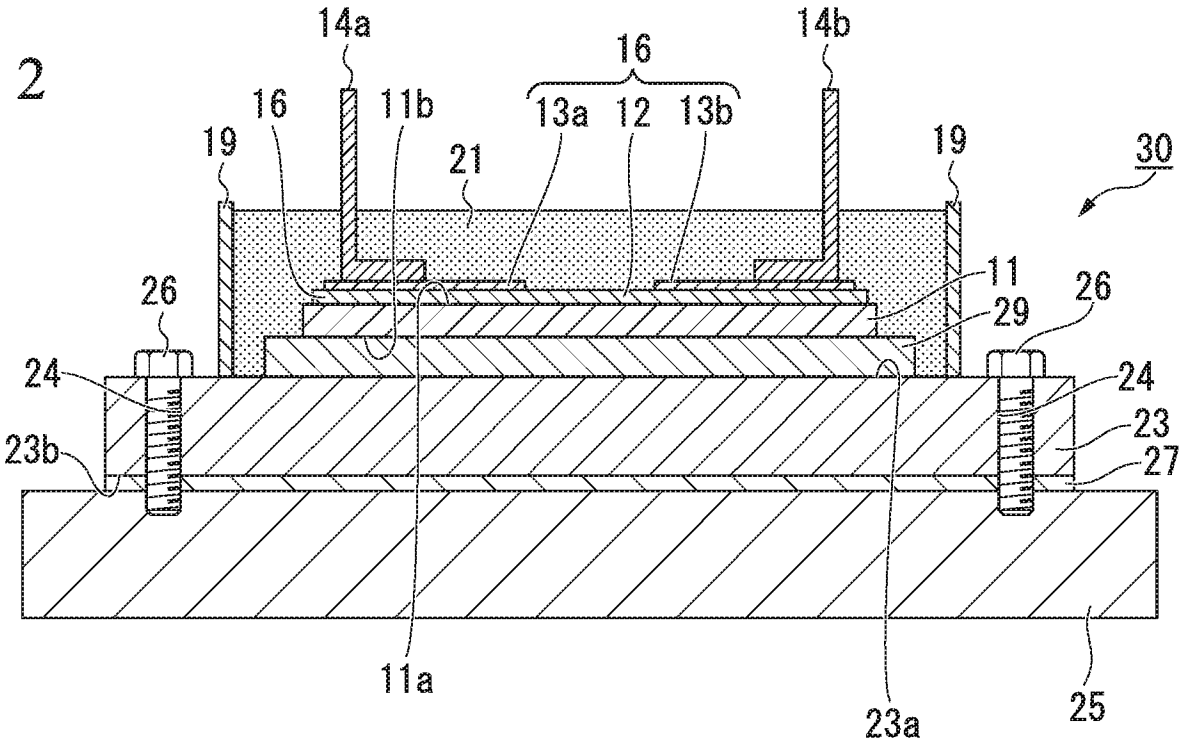
FIG. 2 is a cross-sectional view of a resistor according to a second embodiment of the present invention.

FIG. 2 is a cross-sectional view illustrating a second embodiment of the resistor of the present invention.

In the following description, the same constitution as the resistor of the first embodiment will be given the same reference sign and will not be described again in detail.

In a resistor 30 of the second embodiment, the Al member is constituted of a laminate of a buffer layer 29 made of Al having a purity of 99.98% by mass or more and the heat sink 23. That is, the buffer layer 29 made of Al having a purity of 99.98% by mass or more is formed between the heat sink 23 and the second surface 11*b* side of the ceramic substrate 11. The heat sink 23 and the ceramic substrate 11 are respectively joined to the buffer layer 29 using an Al—Si-based brazing filler metal.

The buffer layer 29 is a thin plate-like member made of highly pure Al having a purity of 99.98% by mass or more. The thickness of the buffer layer 29 needs to be, for example, 0.4 mm or more and 2.5 mm or less. The thickness of the buffer layer 29 is more preferably 0.6 mm or more and 2.0 mm or less. When the above-described buffer layer 29 is formed between the second surface 11*b* of the ceramic substrate 11 and the heat sink 23, heat generated from the chip resistive element 16 is efficiently transferred to the heat sink 23, and the heat can be rapidly diffused.

In addition, when the buffer layer 29 is formed of highly pure Al having a purity of 99.98% by mass or more, deformation resistance decreases, a thermal stress being generated in the ceramic substrate 11 when a thermal cycle is applied can be absorbed by the buffer layer 29, and it is possible to suppress the occurrence of breakage caused by the application of a thermal stress to the ceramic substrate 11.

It is also preferable that the above-described buffer layer 29 be formed between the chip resistive element 16 and the first surface 11*a* side of the ceramic substrate 11.

Even in a case in which the Al member is constituted of the laminate of the buffer layer 29 made of Al having a purity of 99.98% by mass or more and the heat sink 23 as in the present embodiment, the heat sink 23 is formed so that the degree of bending of the opposite surface 23*b* falls into a range of −30 μm/50 mm to 700 μm/50 mm. In such a case, it is possible to suppress the generation of an excessive bending stress on the joint surface between the heat sink 23 and the ceramic substrate 11 and to prevent peeling between the heat sink 23 and the ceramic substrate 11.

Resistor: Third Embodiment

Figure 3:
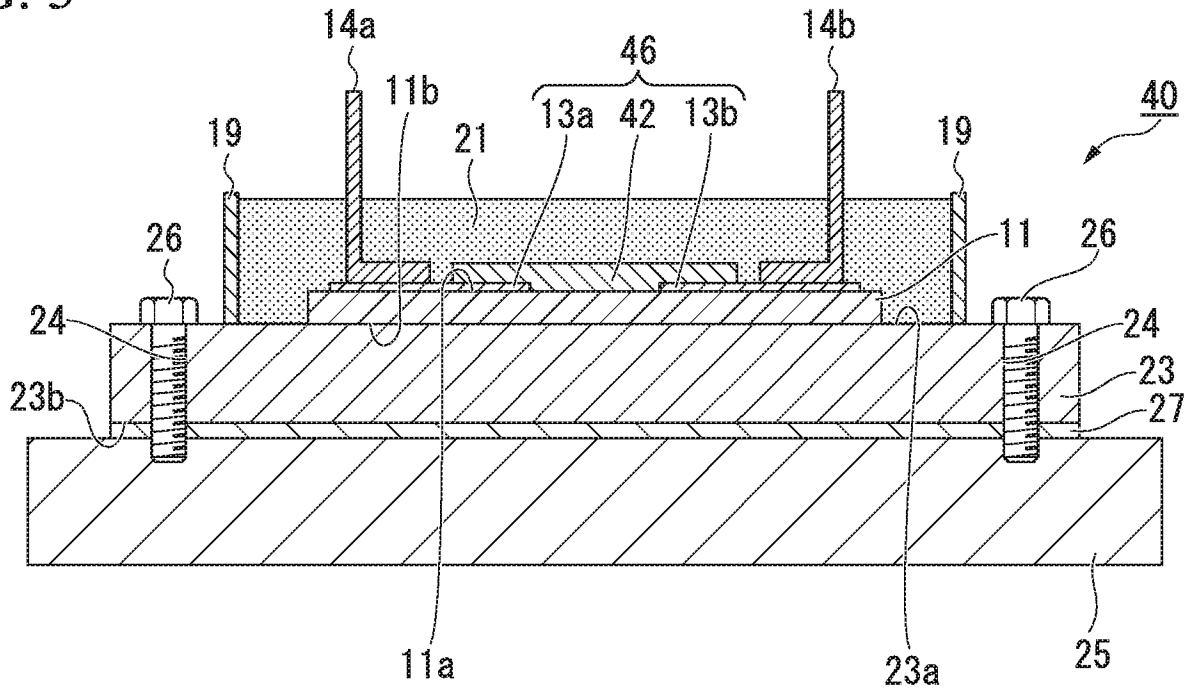
FIG. 3 is a cross-sectional view of a resistor according to a third embodiment of the present invention.

FIG. 3 is a cross-sectional view illustrating a third embodiment of the resistor of the present invention.

In the following description, the same constitution as the resistor of the first embodiment will be given the same reference sign and will not be described again in detail.

In a resistor 40 of the third embodiment, a chip resistive element 46 has a resistive element 42 and the metal electrodes 13*a* and 13*b* for applying voltage to the resistive element 42. In addition, in the present embodiment, a $RuO_2$-based thick film resistive element is used as the resistive element 42.

The thickness of the resistive element 42 made of a $RuO_2$-based thick film resistive element needs to be, for example, 5 μm or more and 10 μm or less and, in the present embodiment, is set to 7 μm. Regarding the formation of the resistive element 42 for which the above-described $RuO_2$-based thick film resistive element is used, the resistive element 12 made of $RuO_2$ is obtained by, for example, printing $RuO_2$ paste on the first surface 11*a* of the ceramic substrate 11 using a thick film printing method, drying, and then firing the paste.

In the present embodiment, the resistive element 42 is formed so as to cover the first surface 11*a* of the ceramic substrate 11 and part of the upper surface side of the metal electrodes 13*a* and 13*b*.

Even in a case in which the $RuO_2$-based thick film resistive element is used as the resistive element 42 as in the present embodiment, the heat sink 23 is formed so that the degree of bending of the opposite surface 23*b* falls into a range of −30 μm/50 mm to 700 μm/50 mm. In such a case, it is possible to suppress the generation of an excessive bending stress on the joint surface between the heat sink 23 and the ceramic substrate 11 and to prevent peeling between the heat sink 23 and the ceramic substrate 11.

Method for Manufacturing Resistor: First Embodiment

Next, a method for manufacturing the resistor 10 according to the first embodiment will be described with reference to FIGS. 4, 5, and 6.

Figure 4:
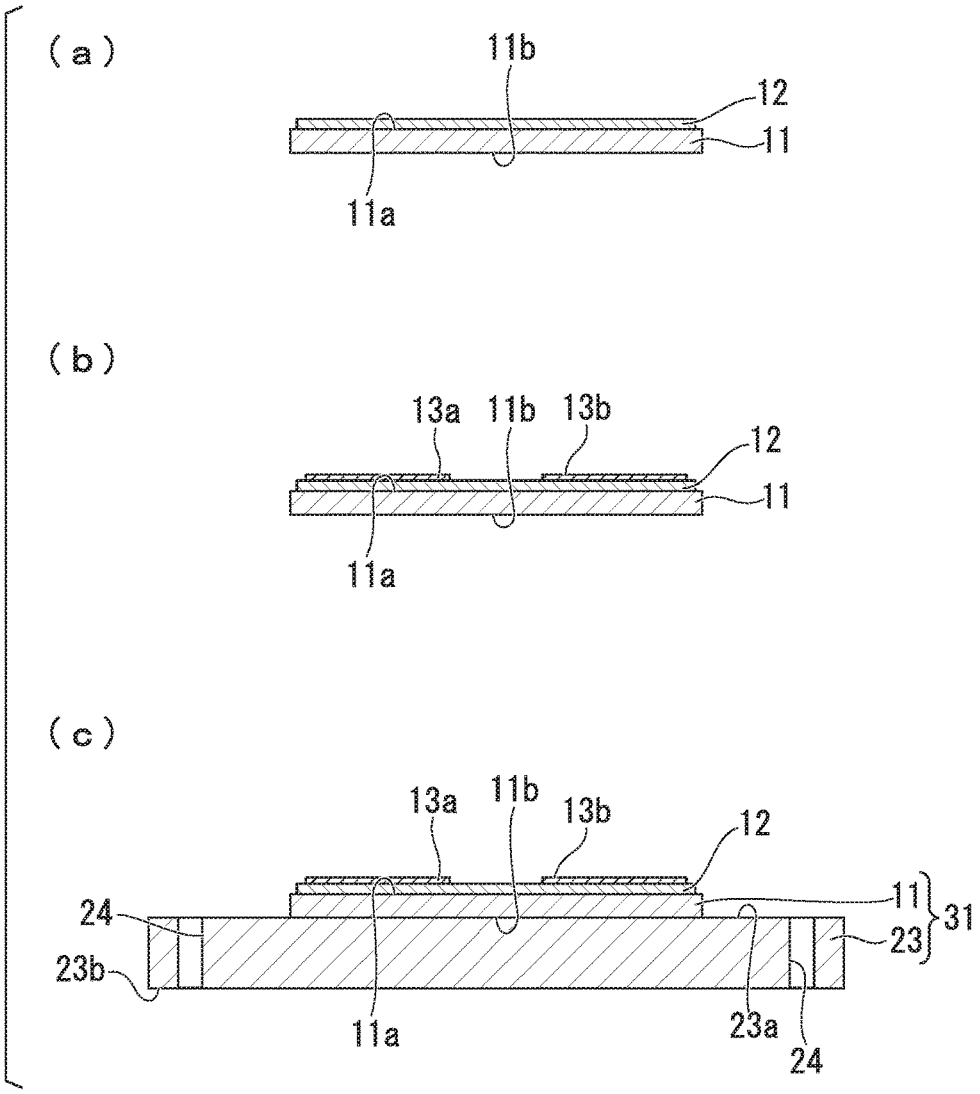
FIG. 4 is a cross-sectional view of a method for manufacturing the resistor according to the first embodiment of the present invention.
Figure 5:
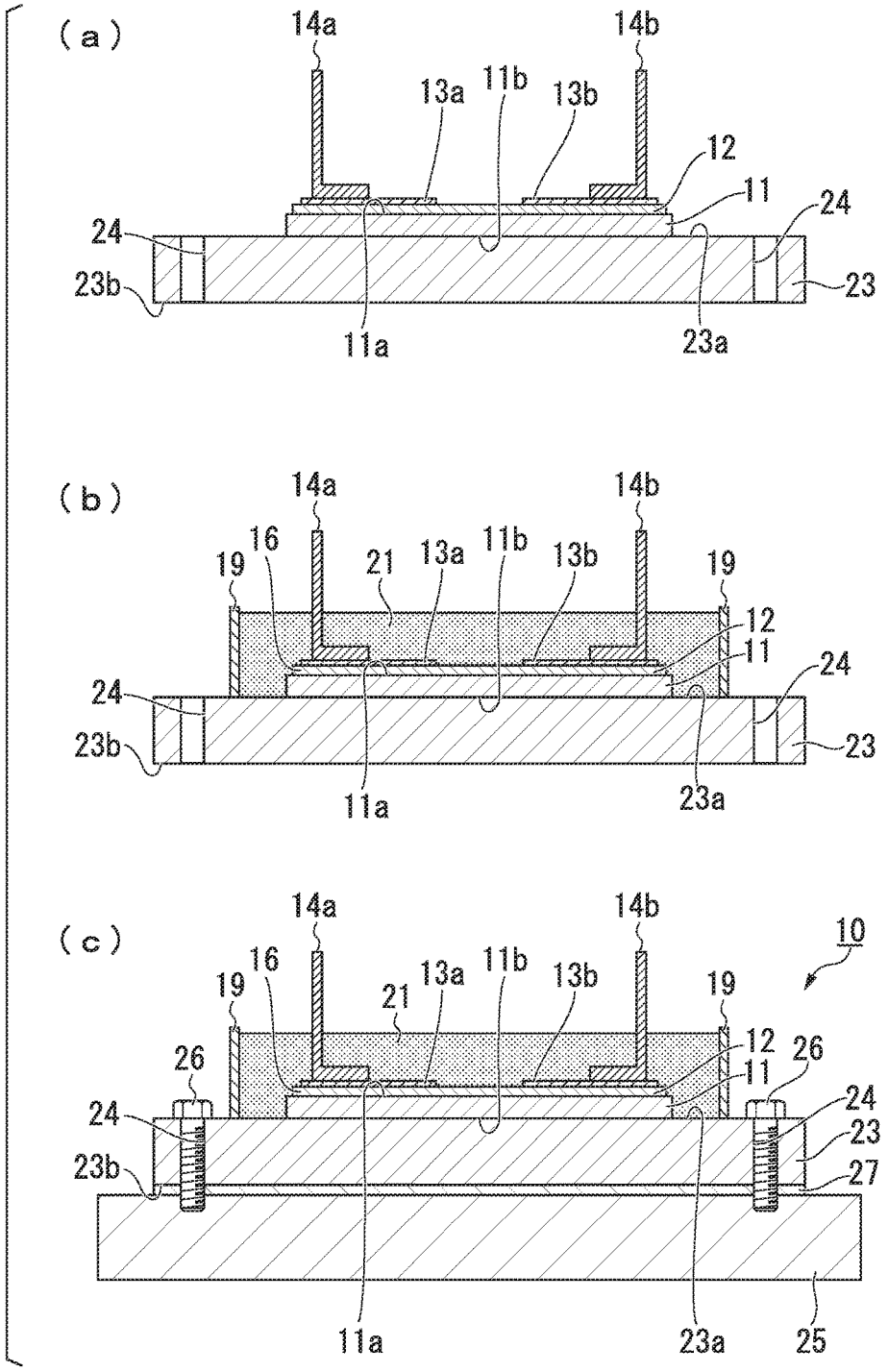
FIG. 5 is a cross-sectional view of the method for manufacturing the resistor according to the first embodiment of the present invention.
Figure 6:
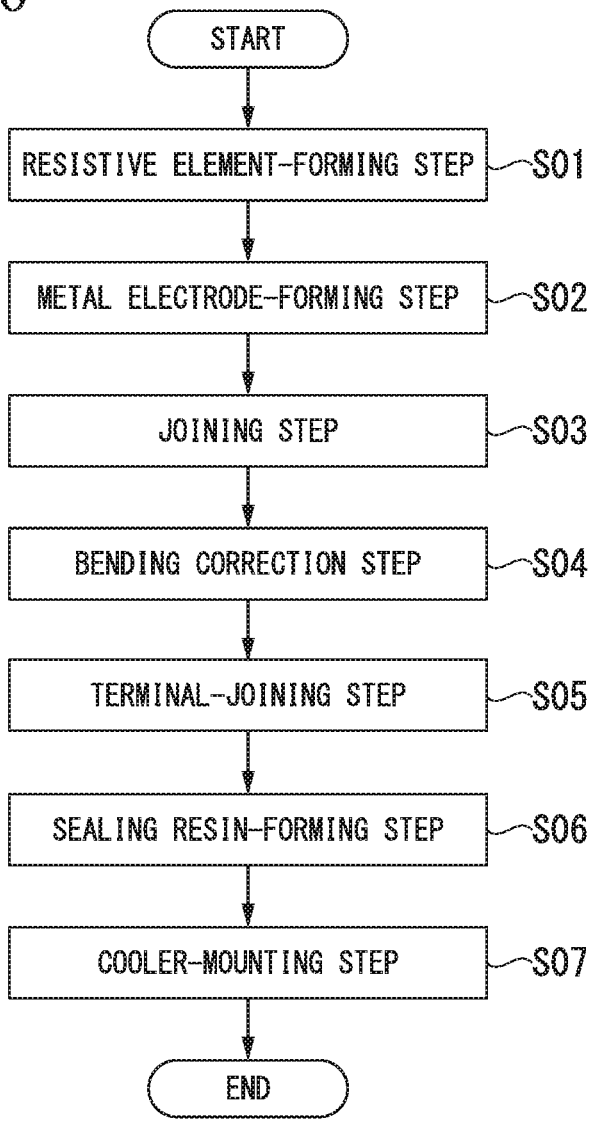
FIG. 6 is a flowchart of the method for manufacturing the resistor according to the first embodiment of the present invention.

FIGS. 4 and 5 are cross-sectional views illustrating a method for manufacturing the resistor according to the first embodiment in a stepwise manner. In addition, FIG. 6 is a flowchart illustrating individual steps in the method for manufacturing the resistor according to the first embodiment.

For example, a ceramic substrate 11 made of AlN and having a thickness of 0.3 mm or more and 1.0 mm or less is prepared. As illustrated in FIG. 4(*a*), the resistive element 12 made of an approximately 0.5 μm-thick Ta—Si-based thin film is formed on the first surface 11*a* of the ceramic substrate 11 using, for example, a sputtering method (resistive element-forming step: S01).

Next, as illustrated in FIG. 4(*b*), for example, approximately 2 to 3 μm-thick metal electrodes 13*a* and 13*b* made of Cu are formed at predetermined locations on the resistive element 12 using, for example, a sputtering method or a plating method (metal electrode-forming step: S02). Therefore, the chip resistive element 16 is formed on the first surface 11*a* of the ceramic substrate 11. It is also preferable to provide a constitution in which an underlayer made of Cr is formed in advance in a Cu lower layer, thereby enhancing the adhesiveness between the resistive element 12 and the metal electrodes 13*a* and 13*b*.

In addition, as illustrated in FIG. 4(*c*), the heat sink 23 is joined to the second surface 11*b* of the ceramic substrate 11 (joining step: S03).

In the joining of the second surface 11*b* of the ceramic substrate 11 and the heat sink 23, an Al—Si-based brazing filler metal foil is sandwiched between the second surface 11*b* of the ceramic substrate 11 and the heat sink 23. In addition, in a vacuum heating furnace, for example, a pressure of 0.5 kgf/cm$^2$ or more and 10 kgf/cm$^2$ or less is applied in the lamination direction, the heating temperature of the vacuum heating furnace is set to 640° C. or higher and 650° C. or lower, and the components are held for 10 minutes or longer and 60 minutes or shorter. Therefore, the Al—Si-based brazing filler metal foil disposed between the second surface 11*b* of the ceramic substrate 11 and the heat sink 23 is melted, and the ceramic substrate 11 and the heat sink 23 are joined to each other using the Al—Si-based brazing filler metal. Therefore, a joined body 31 made up of the ceramic substrate 11 and the heat sink 23 is obtained.

Since the ceramic substrate 11 and the heat sink 23 are joined to each other using the Al—Si-based brazing filler metal, for example, compared with joining using a solder, the heat resistance is significantly enhanced, and a high temperature of 800° C. is not required during the joining step, and thus it is also possible to prevent the previously-formed resistive element 12 from being thermally deteriorated. In addition, like solders, the Al—Si-based brazing filler metal does not significantly expand and contract due to temperature changes, and thus it is possible to reliably prevent the generation of cracks in the joint portion between the ceramic substrate 11 and the heat sink 23 or peeling between the ceramic substrate and the heat sink caused by the temperature changes.

When the heat sink 23 and the ceramic substrate 11 are joined to each other, and the Al—Si-based brazing filler metal is cooled from the melting point to room temperature, there are cases in which the opposite surface 23*b* opposite to the surface 23*a* of the heat sink 23 on the ceramic substrate 11 side bends so as to protrude most in the central region in a direction opposite to the ceramic substrate 11 due to the difference in the coefficient of thermal expansion between the heat sink 23 and the ceramic substrate 11. This arises from the difference in the coefficient of thermal expansion or the difference in thickness between Al constituting the heat sink 23 and ceramic constituting the ceramic substrate 11.

When the degree of bending of the opposite surface 23*b* (the surface in contact with the cooler 25) of the heat sink 23 is caused to fall into a range of −30 μm/50 mm to 700 μm/50 mm, it is possible to ensure adhesiveness between the heat sink 23 and the cooler 25 when the cooler 25 is provided in the heat sink 23 in the post steps. In addition, the generation of an excessive bending stress on the joint surface between the heat sink 23 and the ceramic substrate 11 is suppressed. In order to set the degree of bending of the opposite surface 23*b* (the surface in contact with the cooler 25) of the above-described heat sink 23 in a range of −30 μm/50 mm to 700 μm/50 mm, a bending correction step (S4) of correcting the degree of bending of the heat sink 23 is carried out.

In the bending correction step (S4), first, the bending state of the opposite surface 23*b* of the heat sink 23 is measured or checked. That is, whether the bending state is a downward protrusion-type bending in which the central region of the opposite surface 23*b* protrudes to the exterior more than the circumferential region or an upward protrusion-type bending in which the circumferential region of the opposite surface 23*b* protrudes to the exterior more than the central region is checked.

In addition, whether or not the degree of bending of the opposite surface 23*b* is outside the range of −30 μm/50 mm to 700 μm/50 mm with respect to a flat surface is checked. As a result, in a case in which the degree of bending of the opposite surface 23*b* of the heat sink 23 is outside the above-described range, the correction of the bending state, which will be described below, is carried out. In a case in which the bending direction or the degree of bending is already known or predictable when a number of resistors 10 are manufactured, the above-described checking of the bending state may not be particularly carried out.

Figure 8:
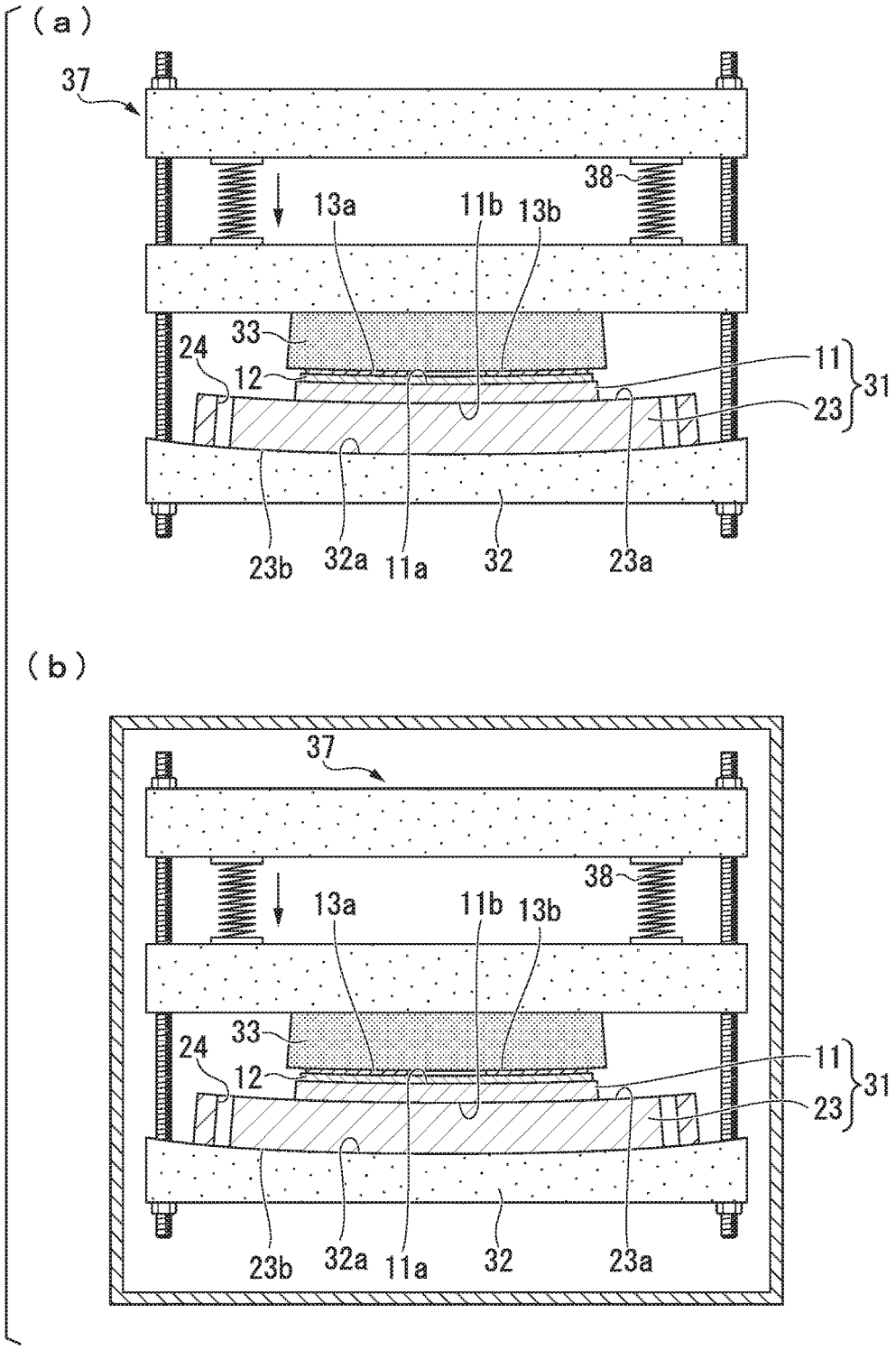
FIG. 8 is a cross-sectional view of a method for manufacturing a resistor according to a third embodiment of the present invention.

In a case in which the bending correction of the opposite surface 23*b* of the heat sink 23 is carried out, a jig 37 illustrated in FIG. 8(*a*) is used. A lower pressurizing plate 32 including a correction surface 32*a* bent at a predetermined curvature is brought into contact with the opposite surface 23*b* side of the heat sink 23. As the lower pressurizing plate 32, a lower pressurizing plate 32 including a correction surface 32*a* having a bending direction opposite to that of the opposite surface 23*b* of the heat sink 23 is used. For example, in a case in which the bending state of the opposite surface 23*b* of the heat sink 23 is the downward protrusion-type bending, a lower pressurizing plate 32 including a correction surface 32*a* made of an upward protrusion-type bent surface is used. In addition, in a case in which the bending state of the opposite surface 23*b* of the heat sink 23 is the upward protrusion-type bending, a lower pressurizing plate 32 including a correction surface 32*a* made of a downward protrusion-type bent surface is used. The correction surface 32*a* of a correction jig 32 is formed so as to have a curvature of, for example, approximately 2,000 nm to 3,000 nm.

In addition, the lower pressurizing plate 32 is brought into contact with the opposite surface 23*b* of the heat sink 23, additionally, an upper pressurizing plate 33 is brought into contact with the metal electrodes 13*a* and 13*b*, for example, a load of approximately 0.5 kg/cm$^2$ to 5 kg/cm$^2$ is applied using pressurizing springs 38, and cold correction is carried out in a room-temperature environment. Therefore, the correction surface 32*a* made of a bent surface having a reverse shape of that of the opposite surface 23*b* is pressed on the opposite surface 23*b* of the heat sink 23, the degree of bending is alleviated, and the shape is corrected into a shape similar to a flat surface. The corrected opposite surface 23*b* of the heat sink 23 obtained in the above-described manner has a degree of bending that falls into a range of −30 μm/50 mm to 700 μm/50 mm with respect to a flat surface.

In addition, the degree of bending of the opposite surface 23*b* of the heat sink 23 can not only be corrected using a single lower pressurizing plate 32 but can also be corrected in a stepwise manner using a plurality of lower pressurizing plates 32. That is, in a case in which the degree of bending of the opposite surface 23*b* of the heat sink 23 is extremely large, there is a concern that wrinkles or fissures may be generated on the opposite surface 23*b* of the heat sink 23 when correction is carried out once using a single lower pressurizing plate 32.

Therefore, it is also possible to employ a method in which cold correction is carried out a plurality of times using a plurality of lower pressurizing plates 32 in which the degree of bending changes in a stepwise manner and the opposite surface 23*b* of the heat sink 23 is made to be similar to a flat surface in a stepwise manner.

In the above-described manner, the opposite surface is corrected so that the degree of bending of the opposite surface 23*b* of the heat sink 23 falls into a range of −30 μm/50 mm to 700 μm/50 mm.

Next, as illustrated in FIG. 5(*a*), the metal electrodes 13*a* and 13*b* are joined to the metal terminals 14*a* and 14*b* respectively using a solder (terminal joining step: S05). The metal terminals 14*a* and 14*b* may be terminals obtained by, for example, bending an approximately 0.3 mm-thick Cu plate material so as to have a substantial L-shaped cross-section. In addition, examples of the solder used to join the metal electrodes 13*a* and 13 and the metal terminals 14*a* and 14*b* include Sn—Ag-based solders, Sn—In-based solders, and Sn—Ag—Cu-based solders. Therefore, the metal electrodes 13*a* and 13*b* and the metal terminals 14*a* and 14*b* are electrically connected to each other.

Next, as illustrated in FIG. 5(*b*), the mold 19 is disposed on the first surface 11*a* of the ceramic substrate 11 so as to surround the circumference of the chip resistive element 16. In addition, a softened insulating resin is loaded to the inside of the mold 19, and the sealing resin 21 sealing the chip resistive element 16 and part of the metal terminals 14*a* and 14*b* is formed (sealing resin-forming step: S06).

Next, as illustrated in FIG. 5(*c*), the grease layer 27 made of a heat-resistant grease is formed on the lower surface of the heat sink 23, and then the cooler 25 is mounted in the heat sink 23 using the screws 26 and 26 (cooler-mounting step: S07).

Through the above-described steps, the resistor 10 according to the first embodiment can be manufactured.

According to the resistor 10 of the present embodiment provided with the above-described constitution and the method for manufacturing the same, the degree of bending of the opposite surface 23*b* of the heat sink (Al member) 23 is caused to fall into a range of −30 μm/50 mm to 700 μm/50 mm with respect to a flat surface, whereby it is possible to suppress the generation of an excessive bending stress on the joint surface between the heat sink 23 and the ceramic substrate 11 and reliably prevent peeling between the heat sink 23 and the ceramic substrate 11.

In addition, when the cooler 25 is provided in the heat sink 23, it is possible to ensure the adhesiveness between the heat sink 23 and the cooler 25. Particularly, in the present embodiment, since a plurality of the screw holes 24 are formed near the circumferential edge of the heat sink 23, and the heat sink 23 and the cooler 25 are fastened to each other using the screws 26 penetrating the screw holes 24, it is possible to improve the adhesiveness between the heat sink 23 and the cooler 25. In addition, it is possible to suppress the generation of an excessive bending stress on the joint surface between the heat sink 23 and the ceramic substrate 11.

In addition, since the ceramic substrate 11 and the heat sink 23 are joined to each other using the Al—Si-based brazing filler metal, even when the resistive element 12 generates heat and reaches a high temperature, it is possible to sufficiently maintain the joint strength, and the heat resistance is excellent compared with the case of, for example, joining using a solder as in the related art. In addition, since it is possible to lower the joint temperature compared with the case of, for example, joining using an Ag—Cu—Ti-based brazing filler metal as in the related art, it becomes possible to reliably prevent the resistive element 12 from being thermally deteriorated during the joining step. In addition, it is possible to reduce thermal loads on the ceramic substrate 11 and the resistive element 12, and it is possible to simplify manufacturing steps and reduce manufacturing costs.

In addition, when the thickness of the ceramic substrate 11 is set to 0.3 mm or more and 1.0 mm or less, it is possible to suppress the occurrence of breakage in the ceramic substrate 11 even when the number of times heat is generated from the resistive element 12 increases.

Furthermore, when the thickness of the metal terminals 14*a* and 14*b* made of Cu is set to 0.1 mm or more, it is possible to ensure a sufficient strength as the terminal and cause relatively large currents to flow. In addition, when the thickness of the metal terminals 14*a* and 14*b* is set to 0.3 mm or less, it is possible to suppress the occurrence of breakage in the ceramic substrate 11 even when the number of times of the generation of heat from the resistive element 12 increases.

In addition, when an insulating resin having a coefficient of thermal expansion (linear expansion rate) in a range of 8 ppm/° C. to 20 ppm/° C. is used as the sealing resin 21, it is possible to minimize the volume changes caused by the thermal expansion of the sealing resin 21 caused by the generation of heat from the resistive element 12. The above-described constitution enables the prevention of the joint portion from being damaged by the application of an excessive stress to the chip resistive element 16 or the metal terminals 14*a* and 14*b* covered with the sealing resin 21 and from occurring problem such as poor electrical conduction.

Method for Manufacturing Resistor: Second Embodiment

Figure 7:
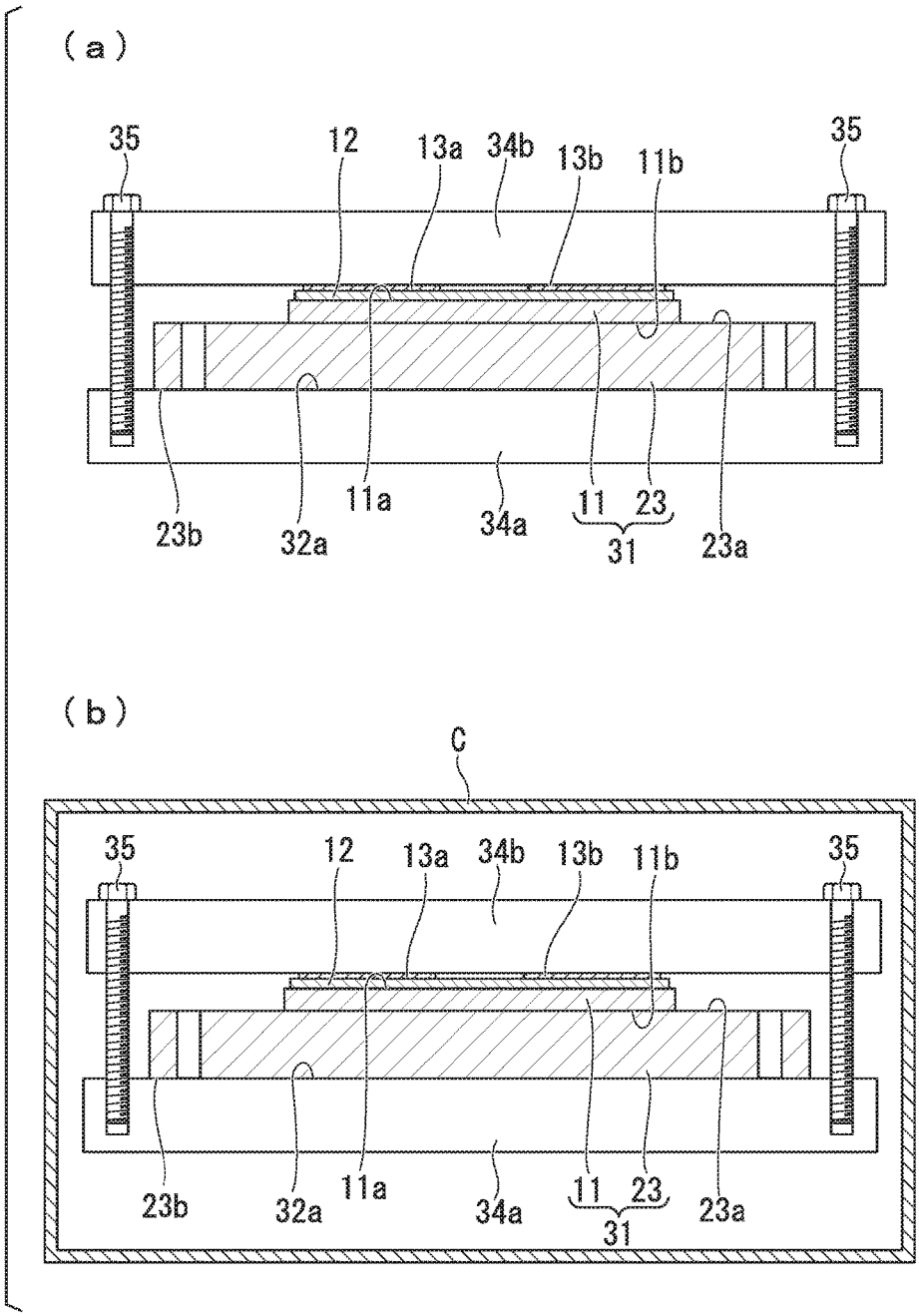
FIG. 7 is a cross-sectional view of a method for manufacturing the resistor according to the second embodiment of the present invention.

FIG. 7 is a cross-sectional view illustrating a second embodiment of the method for manufacturing a resistor according to the present invention.

In the following description, the same constitution as the method for manufacturing the resistor of the first embodiment will be given the same reference sign and will not be described again in detail.

In the method for manufacturing a resistor of the present embodiment, pressure cooling correction is carried out as the bending correction step.

In the bending correction step illustrated in FIG. 7(*a*), first, whether the bending state of the opposite surface 23*b* of the heat sink 23 is a downward protrusion-type bending in which the central region of the opposite surface 23*b* protrudes to the exterior more than the circumferential region or an upward protrusion-type bending in which the circumferential region of the opposite surface 23*b* protrudes to the exterior more than the central region is checked.

In addition, in a case in which the bending correction of the opposite surface 23*b* of the heat sink 23 is carried out, correction jigs 34*a* and 34*b* respectively having a flat surface as the surface are brought into contact with the opposite surface 23*b* side of the heat sink 23 and the ceramic substrate 11 side (the metal electrodes 13*a* and 13*b*) of the joined body 31. In addition, the correction jig 34*a* and the correction jig 34*b* are fastened to each other using fastening screws 35 so that the joined body 31 is sandwiched by predetermined loads, for example, loads of approximately 0.5 kg/cm$^2$ to 5 kg/cm$^2$.

In addition, the joined body 31 sandwiched by the correction jigs 34*a* and 34*b* is introduced into, for example, a cooling device C, cooled to −40° C., held for ten minutes in that state, and then returned to room temperature. Therefore, the degree of bending of the opposite surface 23*b* of the heat sink 23 is alleviated, and the shape is corrected into a shape similar to a flat surface.

The corrected opposite surface 23*b* of the heat sink 23 obtained in the above-described manner has a degree of bending that falls into a range of −30 μm/50 mm to 700 μm/50 mm with respect to a flat surface.

The correction jigs 34*a* and 34*b* being used in the above-described bending correction step are constituted of a metal or a ceramic having high hardness. For example, in the present embodiment, the correction jigs are constituted of SUS.

Method for Manufacturing Resistor: Third Embodiment

FIG. 8 is a cross-sectional view illustrating a third embodiment of the method for manufacturing a resistor of the present invention.

In the following description, the same constitution as the method for manufacturing the resistor of the first embodiment will be given the same reference sign and will not be described again in detail.

In the method for manufacturing a resistor of the present embodiment, the bending correction step is carried out at the same time as the joining step as the pressure correction during joining.

In the joining step and the bending correction step illustrated in FIG. 8(*a*), an Al—Si-based brazing filler metal foil is sandwiched between the second surface 11*b* of the ceramic substrate 11 and the heat sink 23 using a correction jig 37, the lower pressurizing plate 32 including the correction surface 32*a* bent at a predetermined curvature is brought into contact with the opposite surface 23*b* side of the heat sink 23, and the upper pressurizing plate 33 is brought into contact with the metal electrodes 13*a* and 13*b*. The correction surface 32*a* of the lower pressurizing plate 32 is formed so as to have a curvature of, for example, approximately 2,000 nm to 3,000 nm. In addition, the correction jig 37 is pressurized using the pressurizing springs 38.

In addition, the ceramic substrate 11 and the heat sink 23 sandwiched by the correction jigs are introduced into a vacuum heating furnace, the heating temperature of the vacuum heating furnace is set to 640° C. or higher and 650° C. or lower, and the ceramic substrate and the heat sink are held for 10 minutes or longer and 60 minutes or shorter. Therefore, the Al—Si-based brazing filler metal foil disposed between the second surface 11*b* of the ceramic substrate 11 and the heat sink 23 is melted, and the ceramic substrate 11 and the heat sink 23 are joined to each other using this brazing filler metal.

In addition, at the same time, the bending of the opposite surface 23*b* of the heat sink 23 caused during the joining is corrected by the lower pressurizing plate 32 including the correction surface 32*a*, and the corrected opposite surface 23*b* of the heat sink 23 has a degree of bending that falls into a range of −30 μm/50 mm to 700 μm/50 mm with respect to a flat surface.

Method for Manufacturing Resistor: Fourth Embodiment

Figure 9:
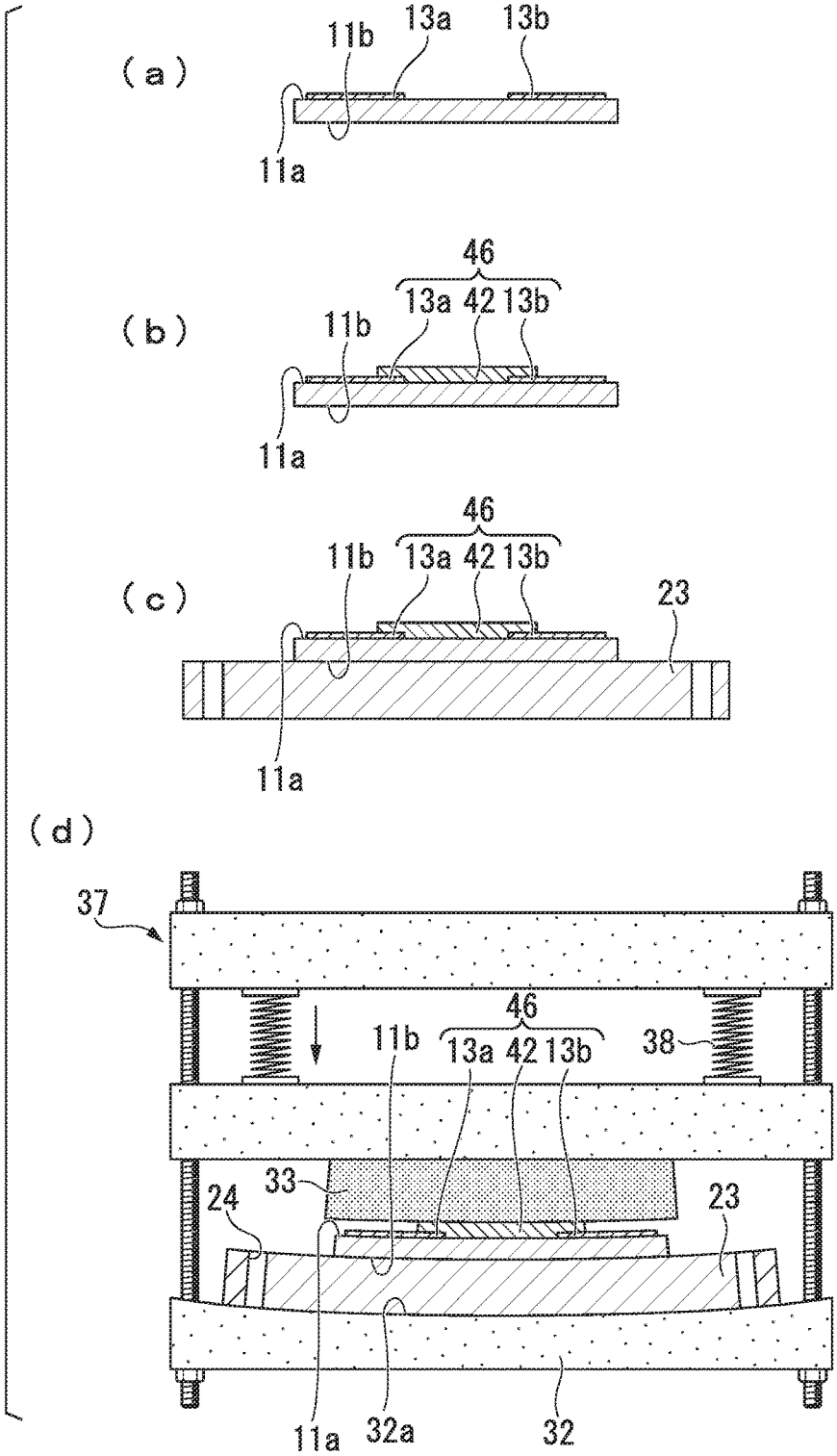
FIG. 9 is a cross-sectional view of a method for manufacturing a resistor according to a fourth embodiment of the present invention.

FIG. 9 is a cross-sectional view illustrating a fourth embodiment of the method for manufacturing a resistor of the present invention.

In the following description, the same constitution as the method for manufacturing the resistor of the first embodiment will be given the same reference sign and will not be described again in detail.

In the manufacturing of the resistor 40 including the resistive element 42 made of a $RuO_2$-based thick film resistive element as illustrated in FIG. 3, for example, a ceramic substrate 11 made of AlN and having a thickness of 0.3 mm or more and 1.0 mm or less is prepared. In addition, as illustrated in FIG. 9(*a*), Ag—Pd paste is printed using, for example, a thick film printing method, dried, and then fired at predetermined locations on the first surface 11*a* of the ceramic substrate 11, thereby forming approximately 7 to 13 μm-thick metal electrodes 13*a* and 13*b* made of an Ag—Pd thick film (metal electrode-forming step).

Next, as illustrated in FIG. 9(*b*), for example, an approximately 7 μm-thick resistive element 42 made of a $RuO_2$-based thick film resistive element is formed so as to come into contact with the first surface 11*a* of the ceramic substrate 11 and the metal electrodes 13*a* and 13*b* (resistive element-forming step). Examples of the method for forming the resistive element 42 made of a $RuO_2$-based thick film resistive element include a method in which $RuO_2$ paste is printed using, for example, a thick film printing method, dried, and then fired on the first surface 11*a* of the ceramic substrate 11.

In addition, as illustrated in FIG. 9(*c*), the heat sink 23 is joined to the second surface 11*b* of the ceramic substrate 11 (joining step). In the joining of the second surface 11*b* of the ceramic substrate 11 and the heat sink 23, an Al—Si-based brazing filler metal foil is sandwiched between the second surface 11*b* of the ceramic substrate 11 and the heat sink 23. In addition, in a vacuum heating furnace, for example, a pressure of 0.5 kgf/cm$^2$ or more and 10 kgf/cm$^2$ or less is applied in the lamination direction, the heating temperature of the vacuum heating furnace is set to 640° C. or higher and 650° C. or lower, and the components are held for 10 minutes or longer and 60 minutes or shorter. Therefore, the Al—Si-based brazing filler metal foil disposed between the second surface 11*b* of the ceramic substrate 11 and the heat sink 23 is melted, and the ceramic substrate 11 and the heat sink 23 are joined to each other using the Al—Si-based brazing filler metal. Therefore, the joined body 31 made up of the ceramic substrate 11 and the heat sink 23 is obtained.

When the heat sink 23 and the ceramic substrate 11 are joined to each other, and the Al—Si-based brazing filler metal is cooled from the melting point to room temperature, there are cases in which the opposite surface 23*b* opposite to the surface 23*a* of the heat sink 23 on the ceramic substrate 11 side bends so as to protrude most in the central region in a direction opposite to the ceramic substrate 11 due to the difference in the coefficient of thermal expansion between the heat sink 23 and the ceramic substrate 11. This arises from the difference in the coefficient of thermal expansion or the difference in thickness between Al constituting the heat sink 23 and ceramic constituting the ceramic substrate 11.

When the degree of bending of the opposite surface 23*b* (the surface in contact with the cooler 25) of the heat sink 23 is caused to fall into a range of −30 μm/50 mm to 700 μm/50 mm, it is possible to ensure adhesiveness between the heat sink 23 and the cooler 25 when the cooler 25 is provided in the heat sink 23 in the post steps. In addition, the generation of an excessive bending stress on the joint surface between the heat sink 23 and the ceramic substrate 11 is suppressed. In order to set the degree of bending of the opposite surface 23*b* (the surface in contact with the cooler 25) of the above-described heat sink 23 in a range of −30 μm/50 mm to 700 μm/50 mm, a bending correction step of correcting the degree of bending of the heat sink 23 is carried out.

In the bending correction step, first, the bending state of the opposite surface 23*b* of the heat sink 23 is measured or checked. That is, whether the bending state is a downward protrusion-type bending in which the central region of the opposite surface 23*b* protrudes to the exterior more than the circumferential region or an upward protrusion-type bending in which the circumferential region of the opposite surface 23*b* protrudes to the exterior more than the central region is checked.

In addition, whether or not the degree of bending of the opposite surface 23*b* is outside the range of −30 μm/50 mm to 700 μm/50 mm with respect to a flat surface is checked. As a result, in a case in which the degree of bending of the opposite surface 23*b* of the heat sink 23 is outside the above-described range, the correction of the bending state, which will be described below, is carried out. In a case in which the bending direction or the degree of bending is already known or predictable when a number of resistors 40 are manufactured, the above-described checking of the bending state may not be particularly carried out.

In a case in which the bending correction of the opposite surface 23*b* of the heat sink 23 is carried out, the jig 37 illustrated in FIG. 9(*d*) is used. A lower pressurizing plate 32 including a correction surface 32*a* bent at a predetermined curvature is brought into contact with the opposite surface 23*b* side of the heat sink 23. As the lower pressurizing plate 32, a lower pressuring plate 32 including a correction surface 32*a* having a bending direction opposite to that of the opposite surface 23*b* of the heat sink 23 is used. For example, in a case in which the bending state of the opposite surface 23*b* of the heat sink 23 is the downward protrusion-type bending, a lower pressurizing plate 32 including a correction surface 32*a* made of an upward protrusion-type bent surface is used. In addition, in a case in which the bending state of the opposite surface 23*b* of the heat sink 23 is the upward protrusion-type bending, a lower pressurizing plate 32 including a correction surface 32*a* made of a downward protrusion-type bent surface is used. The correction surface 32*a* of the correction jig 32 is formed so as to have a curvature of, for example, approximately 2,000 nm to 3,000 nm.

In addition, the lower pressurizing plate 32 is brought into contact with the opposite surface 23*b* of the heat sink 23, additionally, an upper pressurizing plate 33 is brought into contact with the resistive element 42, for example, a load of approximately 0.5 kg/cm$^2$ to 5 kg/cm$^2$ is applied using pressurizing springs 38, and cold correction is carried out in a room-temperature environment. Therefore, the correction surface 32*a* made of a bent surface having a reverse shape of that of the opposite surface 23*b* is pressed on the opposite surface 23*b* of the heat sink 23, the degree of bending is alleviated, and the shape is corrected into a shape similar to a flat surface. The corrected opposite surface 23*b* of the heat sink 23 obtained in the above-described manner has a degree of bending that falls into a range of −30 μm/50 mm to 700 μm/50 mm with respect to a flat surface.

In addition, the degree of bending of the opposite surface 23*b* of the heat sink 23 can not only be corrected using a single lower pressurizing plate 32 but can also be corrected in a stepwise manner using a plurality of lower pressurizing plates 32. That is, in a case in which the degree of bending of the opposite surface 23*b* of the heat sink 23 is extremely large, there is a concern that wrinkles or fissures may be generated on the opposite surface 23*b* of the heat sink 23 when correction is carried out once using a single lower pressurizing plate 32.

Therefore, it is also possible to employ a method in which cold correction is carried out a plurality of times using a plurality of lower pressurizing plates 32 in which the degree of bending changes in a stepwise manner and the opposite surface 23*b* of the heat sink 23 is made to be similar to a flat surface in a stepwise manner.

In the above-described manner, the opposite surface is corrected so that the degree of bending of the opposite surface 23*b* of the heat sink 23 falls into a range of −30 μm/50 mm to 700 μm/50 mm with respect to a flat surface.

After that, the metal terminals 14*a* and 14*b* are joined to the metal electrodes 13*a* and 13*b* respectively using a solder, the mold 19 is disposed on the first surface 11*a* of the ceramic substrate 11, then, the sealing resin 21 is formed, and furthermore, the cooler 25 is mounted in the heat sink 23, whereby the resistor 40 including the resistive element 42 made of a $RuO_2$-based thick film resistive element as illustrated in FIG. 3 can be manufactured.

EXAMPLES

Hereinafter, the results of confirmation experiments carried out to confirm the effects of the present invention will be described.

Examples 1 to 5 of the Invention

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a heat sink (20 mm×13 mm×3 mmt) made of an Al alloy (A1050) was laminated on the second surface of the ceramic substrate through an Al—Si-based brazing filler metal, a pressure of 3 kgf/cm$^2$ was applied in the lamination direction, and the components were held in a vacuum atmosphere at 645° C. for 30 minutes so as to join the ceramic substrate and the heat sink through the Al—Si-based brazing filler metal. In addition, the opposite surface of the heat sink was corrected into a predetermined degree of bending (amount of warpage) by means of cold correction, which is the correction step described in the first embodiment of the method for manufacturing a resistor. That is, the amounts of warpage were set to −30 μm in Example 1 of the invention, 0 μm (flat surface) in Example 2 of the invention, 100 μm in Example 3 of the invention, 350 μm in Example 4 of the invention, and 700 μm in Example 5 of the invention. In addition, Cu terminals were joined onto the Cu electrodes using a Sn—Ag solder.

Example 6 of the Invention

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a heat sink (20 mm×13 mm×3 mmt) made of an Al alloy (A1050) was laminated on the second surface of the ceramic substrate through an Al—Si-based brazing filler metal, a pressure of 3 kgf/cm$^2$ was applied in the lamination direction, and the components were held in a vacuum atmosphere at 645° C. for 30 minutes so as to join the ceramic substrate and the heat sink through the Al—Si-based brazing filler metal. In addition, the opposite surface of the heat sink was corrected into a predetermined degree of bending (amount of warpage) by means of pressure cold correction, which is the correction step described in the second embodiment of the method for manufacturing a resistor. That is, the amount of warpage was set to 100 μm in Example 6 of the invention. In addition, Cu terminals were joined onto the Cu electrodes using a Sn—Ag solder.

Example 7 of the Invention

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a heat sink (20 mm×13 mm×3 mmt) made of an Al alloy (A1050) was laminated on the second surface of the ceramic substrate through an Al—Si-based brazing filler metal, a pressure of 3 kgf/cm$^2$ was applied in the lamination direction, and the components were held in a vacuum atmosphere at 645° C. for 30 minutes so as to join the ceramic substrate and the heat sink through the Al—Si-based brazing filler metal. In addition, the opposite surface of the heat sink was corrected into a predetermined degree of bending (amount of warpage) by means of pressure correction during joining, which is the correction step described in the third embodiment of the method for manufacturing a resistor. That is, the amount of warpage was set to 100 μm in Example 7 of the invention. In addition, Cu terminals were joined onto the Cu electrodes using a Sn—Ag solder.

Comparative Examples 1 and 2

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a heat sink (20 mm×13 mm×3 mmt) made of an Al alloy (A1050) was laminated on the second surface of the ceramic substrate through an Al—Si-based brazing filler metal, a pressure of 3 kgf/cm$^2$ was applied in the lamination direction, and the components were held in a vacuum atmosphere at 645° C. for 30 minutes so as to join the ceramic substrate and the heat sink through the Al—Si-based brazing filler metal. In addition, the opposite surface of the heat sink was corrected into a predetermined degree of bending (amount of warpage) by means of cold correction, which is the correction step described in the first embodiment of the method for manufacturing a resistor. That is, the amounts of warpage were set to 800 μm in Comparative Example 1 and −60 μm in Comparative Example 2. In addition, Cu terminals were joined onto the Cu electrodes using a Sn—Ag solder.

Comparative Example 3

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a Cu film was formed on the second surface of the ceramic substrate using a sputtering method, and then 1.6 μm-thick Cu layer (10 mm×10 mm) were formed using a plating method. Next, a heat sink (20 mm×13 mm×3 mmt) made of an Al alloy (A1050) was joined to the second surface of the ceramic substrate through an Sn—Ag solder. The correction step was not carried out after the joining by means of soldering. The amount of warpage was set to −60 μm. In addition, Cu terminals were joined onto the Cu electrodes using a Sn—Ag solder.

Comparative Example 4

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a Cu film was formed on the second surface of the ceramic substrate using a sputtering method, and then 1.6 μm-thick Cu layer (10 mm×10 mm) were formed using a plating method. Next, a heat sink (20 mm×13 mm×3 mmt) made of an Al alloy (A1050) was joined to the second surface of the ceramic substrate through an Sn—Ag-based solder. In addition, the bending of the opposite surface of the heat sink was corrected by means of cold correction, which is the correction step described in the first embodiment of the method for manufacturing a resistor. In addition, Cu terminals were joined onto the Cu electrodes using a Sn—Ag solder.

Comparative Example 5

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a Cu film was formed on the second surface of the ceramic substrate using a sputtering method, and then 1.6 μm-thick Cu layer (10 mm×10 mm) were formed using a plating method. Next, a heat sink (20 mm×13 mm×3 mmt) made of an Al alloy (A1050) was joined to the second surface of the ceramic substrate through an Sn—Ag-based solder. In addition, the bending of the opposite surface of the heat sink was corrected by means of cold correction, which is the correction step described in the second embodiment of the method for manufacturing a resistor. In addition, Cu terminals were joined onto the Cu electrodes using a Sn—Ag solder.

Comparative Example 6

A Ta—Si-based resistive element (10 mm×10 mm×0.5 μm) was formed on first surface of a ceramic substrate made of AlN (15 mm×11 mm×0.635 mmt) using a sputtering method. Next, a Cu film was formed on both upper ends of the resistive element using a sputtering method, and then 1.6 μm-thick Cu electrodes (2 mm×10 mm) were formed using a plating method. Next, a Cu film was formed on the second surface of the ceramic substrate using a sputtering method, and then 1.6 μm-thick Cu layer (10 mm×10 mm) were formed using a plating method. Next, a heat sink (20 mm×13 mm×3 mmt) made of an Al alloy (A1050) was joined to the second surface of the ceramic substrate through an Sn—Ag-based solder. In addition, the bending of the opposite surface of the heat sink was corrected by means of cold correction, which is the correction step described in the third embodiment of the method for manufacturing a resistor. In addition, Cu terminals were joined onto the Cu electrodes using a Sn—Ag solder.

For Examples 1 to 7 of the invention and Comparative Examples 1 to 6 described above, a thermal cycle test, a test of leaving the resistor at a high temperature, and an electric conduction test were carried out respectively.

In the thermal cycle test, a thermal cycle was repeated on each of the samples in a range of −40° C. to 125° C. The number of repetitions was set to 3,000 cycles. In addition, after the test, the status of cracking or peeling in the joint portion between the ceramic substrate and the heat sink and breakage of the ceramic substrate were observed.

In the test of leaving the resistor at a high temperature, each of the samples was left to stand at 125° C. for 1,000 hours, and the status of cracking or peeling in the joint portion between the ceramic substrate and the heat sink was observed.

In the electric conduction test, electricity was conducted between the Cu terminals in each of the samples for five minutes at 200 W, and the electric conduction status was checked.

The results of the thermal cycle test, the test of leaving the resistor at a high temperature, and the electric conduction test carried out on the respective samples in the above-described manner are shown in Table 1. In Table 1 below, regarding the thermal cycle test, resistors in which cracking, peeling, or breakage occurred are indicated by B, and resistors in which the joint state was not changed are indicated by A.

In addition, regarding the test of leaving the resistor at a high temperature, resistors in which cracking or peeling occurred are indicated by B, and resistors in which the joint state was not changed are indicated by A. In addition, in the electric conduction test, resistors in which currents flowed are indicated by A, and resistors in which electricity was not conducted are indicated by B.

TABLE 1

| | | | | Test results | | |
|---|---|---|---|---|---|---|
| | Joining method | Correction method | Degree of bending | Thermal cycle test | Test of leaving resistor at high temperature | Electric conduction test |
| Example 1 of the invention | Brazing | Cold correction | −30 μm | A | A | A |
| Example 2 of the invention | Brazing | Cold correction | 0 μm | A | A | A |
| Example 3 of the invention | Brazing | Cold correction | 100 μm | A | A | A |
| Example 4 of the invention | Brazing | Cold correction | 350 μm | A | A | A |
| Example 5 of the invention | Brazing | Cold correction | 700 μm | A | A | A |
| Example 6 of the invention | Brazing | Pressure cold correction | 100 μm | A | A | A |
| Example 7 of the invention | Brazing | Pressure correction during joining step | 100 μm | A | A | A |
| Comparative Example 1 | Brazing | Cold correction | 800 μm | B | A | A |
| Comparative Example 2 | Brazing | Cold correction | −60 μm | A | A | B (note 1) |
| Comparative Example 3 | Soldering | — | −60 μm | B (note 2) | B (note 3) | B (note 1) |
| Comparative Example 4 | Soldering | Cold correction | — | The tests were not possible due to the generation of cracks in the solder portion after the cold correction | | |
| Comparative Example 5 | Soldering | Pressure cold correction | — | The tests were not possible since the bending returned to the state before correction during soldering of the element | | |
| Comparative Example 6 | Soldering | Pressure correction during joining step | — | The tests were not possible since the solder flowed out during pressurization and soldering | | |

(note 1)
Poor electric conduction occurred between the terminals after the test.
(note 2)
50% or more of the joint area between the heat sink and the ceramic substrate peeled.
(note 3)
30% or more of the joint area between the heat sink and the ceramic substrate decreased.

As shown in Table 1, in Examples 1 to 7 of the invention, favorable results were obtained in all of the thermal cycle test, the test of leaving the resistor at a high temperature, and the electric conduction test.

On the other hand, in Comparative Example 1, breakage occurred in the ceramic substrate after the thermal cycle test.

In addition, in Comparative Example 2 and Comparative Example 3 of the related art, electric conduction between the terminals was poor in the electric conduction test. This is because, in Comparative Example 2 and Comparative Example 3, the degree of bending was as high as −60 μm, and heat was not smoothly diffused, and thus the solder joining the metal electrodes and the metal terminals was melted, and the metal electrodes and the metal terminals were disconnected from each other. In addition, in Comparative Example 3, 50% or more of the joint area between the ceramic substrate and the heat sink was peeled in the thermal cycle test. In addition, the joint strength between the ceramic substrate and the heat sink decreased by 30% or more. In addition, the electric conduction was poor between the terminals in the electric conduction test.

In Comparative Example 4, since cracking had already occurred in the solder after the cold correction, it was not possible to carry out any of the thermal cycle test, the test of leaving the resistor at a high temperature, and the electric conduction test.

In Comparative Example 5, when an element was soldered to the resistor after pressure cooling correction, the warpage of the heat sink returned to the state before the pressure cooling correction was carried out, and thus it was not possible to carry out any of the thermal cycle test, the test of leaving the resistor at a high temperature, and the electric conduction test.

In Comparative Example 6, when pressure correction was carried out during the joining step, the solder flowed out from between the ceramic substrate and the heat sink due to the pressing force, and joining was not possible.

From the above-described results, it was confirmed that, according to the present invention, it is possible to join ceramic substrates and Al members without causing significant bending and manufacture resistors in which joint portions are not damaged.

REFERENCE SIGNS LIST

10 RESISTOR
11 CERAMIC SUBSTRATE
12 RESISTIVE ELEMENT
13*a*, 13*b* METAL ELECTRODE
14*a*, 14*b* METAL TERMINAL
23 HEAT SINK (Al MEMBER)
29 BUFFER LAYER
32 CORRECTION JIG

The invention claimed is:

1. A resistor comprising:

a chip resistive element which includes a resistive element and metal electrodes and which is formed on first surface of a ceramic substrate;

metal terminals electrically joined to the metal electrodes; and an Al member formed on second surface side of the ceramic substrate, wherein the ceramic substrate and the Al member are joined to each other using an Al—Si-based brazing filler metal, the metal electrodes and the metal terminals are joined to each other using a solder, and a degree of bending of an opposite surface of the Al member opposite to a surface on the ceramic substrate side is in a range of −30 μm/50 mm to 700 μm/50 mm, wherein a thickness of the ceramic substrate is in a range of 0.3 mm to 1.0 mm, wherein a thickness of the Al member is in a range of 3.0 mm to 10.0 mm, and wherein a thickness of the metal electrodes is in a range of 2 μm or more and 3 μm or less.

2. The resistor according to claim 1, wherein the Al member is a laminate of a buffer layer made of Al having a purity of 99.98% by mass or more and a heat sink and the buffer layer and the second surface of the ceramic substrate are joined to each other using an Al—Si-based brazing filler metal.

3. The resistor according to claim 2, wherein a thickness of the buffer layer is in a range of 0.4 mm to 2.5 mm.

4. The resistor according to claim 1, wherein the chip resistive element, the metal electrodes, and the metal terminals are at least partially covered with an insulating sealing resin and the sealing resin is a resin having a coefficient of thermal expansion in a range of 8 ppm/° C. to 20 ppm/° C.

5. A method for manufacturing a resistor with which the resistor according to claim 1 is manufactured, comprising:

a joining step of disposing an Al—Si-based brazing filler metal between the ceramic substrate and the Al member, heating the ceramic substrate and the Al member under pressure in a lamination direction, and joining the ceramic substrate and the Al member to each other using the brazing filler metal, thereby forming a joined body;

a bending correction step of correcting bending of the Al member; and a terminal-joining step of joining metal electrodes to metal terminals, wherein a thickness of the ceramic substrate is in a range of 0.3 mm to 1.0 mm, wherein a thickness of the Al member is in a range of 3.0 mm to 10.0 mm, and wherein a thickness of the metal electrodes is in a range of 2 μm or more and 3 μm or less.

6. The method for manufacturing a resistor according to claim 5, wherein the bending correction step is a step of carrying out cold correction in which a correction jig having a predetermined curvature is brought into contact with the Al member side of the joined body and the joined body is pressed from the ceramic substrate side.

7. The method for manufacturing a resistor according to claim 5, wherein the bending correction step is a step of carrying out pressure cooling correction in which the joined body is sandwiched by flat correction jigs respectively disposed on the Al member side and the ceramic substrate side and is cooled to at least 0° or lower and is then returned to room temperature.

8. The method for manufacturing a resistor according to claim 5, wherein the bending correction step is a step of disposing a correction jig having a predetermined curvature on the Al member side prior to the joining step.

9. The method for manufacturing a resistor according to claim 5, further comprising:

a sealing resin-forming step of disposing a mold so as to surround a circumference of the chip resistive element and loading a softened sealing resin to an inside of the mold.

10. The resistor according to claim 1, wherein the resistive element is consisting of Ta—Si or $RuO_2$.

11. The resistor according to claim 1, wherein the metal electrodes are selected from a group consisting of Cu, a Cu alloy, Al, and Ag.

* * * * *